United States Patent [19]

Coddington et al.

[11] Patent Number: 4,835,455

[45] Date of Patent: May 30, 1989

[54] REFERENCE VOLTAGE GENERATOR

[75] Inventors: John D. Coddington, Plymouth; Jeffrey P. Graebel, Maple Grove, both of Minn.

[73] Assignee: Honeywell Inc., Minneapolis, Minn.

[21] Appl. No.: 244,977

[22] Filed: Sep. 15, 1988

[51] Int. Cl.[4] ..... G05F 3/20

[52] U.S. Cl. ..... 323/314; 323/316; 307/455

[58] Field of Search ..... 323/311, 312, 313, 314, 323/315, 316; 330/257, 288, 297; 307/446, 455

[56] References Cited

U.S. PATENT DOCUMENTS

| | | | |
|---|---|---|---|
| 4,100,477 | 7/1978 | Tam | 323/314 |
| 4,249,091 | 2/1981 | Yamagiwa | 307/203 |
| 4,258,277 | 3/1981 | Nutz | 307/350 |
| 4,506,208 | 3/1985 | Nagano | 323/314 |
| 4,737,663 | 4/1988 | Varadarajan | 323/314 |

OTHER PUBLICATIONS

"Linear Integrated Circuits Data Handbook", by National Semiconductor Corporation, Feb. 1975, pp. 1-74.

D. W. Nielsen, Project Status Report (Management), VHSIC Phase II, Submicrometer Technology Development, Monthly Report, May and Jun. 1985.

*Primary Examiner*—Peter S. Wong

*Attorney, Agent, or Firm*—W. T. Udseth

[57] ABSTRACT

A voltage reference generator based on a pair of differentially connected transistor devices, having a current sink at that connection, with one leg of the differential pair adapted for connection to a first voltage and the other leg having a pair of series-connected impedances connected thereto and adapted at the opposite end for connection to a second voltage supply.

13 Claims, 1 Drawing Sheet

REFERENCE VOLTAGE GENERATOR

The Government has rights in this invention pursuant to Contract No. F33615-84-C-1500, awarded by the Department of the Air Force.

BACKGROUND OF THE INVENTION

The present invention relates to reference voltage generators and, more particularly, to reference voltage generators which must provide a reference voltage quite near the value of voltage provided by a power supply in a plurality of power supplies.

Electronic circuit systems often require provision therein of precise values of voltage for many different purposes. Among these purposes is the provision of a reference level about which switching between logic states occurs in certain kinds of logic gate circuits. One class of logic circuits in which this is used is the well known class of current mode logic (CML) gate circuits.

CML logic gates are typically formed about a pair of npn bipolar transistors having the emitters thereof connected together and to a current sink. Each collector of this pair of transistors is connected through a corresponding collector load resistor to the CML logic gate supply voltage provided with respect to the ground reference voltage or datum voltage. The base of one of the transistors serves as an input of the logic gate and, if further gate inputs are required, additional bipolar transistors can be provided, each having its base as a gate input and each having its emitter connected to the emitter of, and its collector connected to the collector of, that transistor already serving as a gate input.

The other transistor in the original pair of emitter-connected bipolar transistors forming a CML logic gate, or the reference transistor, has its base connected to a reference voltage which sets the voltage value about which input voltages can switch the gate from one logic state to another, i.e. the input voltage switching range. Thus, a voltage on the base of the logic gate input transistor of the emitter-connected pair of a sufficient magnitude will switch that transistor sufficiently "on" to supply the current demanded by the current sink and raise the voltage at the emitter thereof sufficiently to result in switching the other transistor in the pair, or the reference transistor connected to the reference supply, into the "off" condition. Similarly, a sufficiently low voltage applied to the base of the input transistor will lead to the input transistor being switched into the "off" condition, and with the current for the current sink supplied by the reference transistor. Thus, two different voltage levels can be established across each of the collector load resistors of this emitter-connected pair of transistors to result in two different logic states across each being represented thereby. The state at any one time across one resistor is, of course, the complement of that across the other.

These voltages across the collector loads of the emitter-connected transistors have a close relationship with the voltage value of the supply connected thereto. Since the current sink demands a substantially constant current, and either one or the other of these transistors is in the "off" condition, the voltage occurring across either load resistor for its corresponding transistor being "on" in one logic state will be substantially constant since a fixed current flows therethrough. The voltage at the transistor collector then will have a fixed relationship to the voltage value of the power supply to which the other end of its resistor is connected. Of course, for either of these transistors being in the "off" condition, the voltage occurring at its collector will be the power supply voltage. Thus, if the gate circuit outputs are taken at the collectors of the emitter-connected pair of transistors where each is connected to one of these resistors, the outputs will vary with variations in the gate supply voltage value, with respect to ground, but will remain essentially constant with respect to this power supply voltage value.

Since the logic gate output voltages representing logic states will usually be used to operate one or more succeeding logic gates of this same type, the variation in output voltage with changes in the value of the power supply connected to the load resistors in a CML logic gate can lead to difficulty. Such succeeding logic states, if the input voltage range in such gates for switching between logic states remains fixed, may have the gate output voltage values of a preceding gate connected to its input drift to values outside part of this input voltage switching range. Thus, there is a substantial value in having the reference voltage for the reference transistor in the emitter-connected pair vary with the supply voltage to the CML logic gates so that the gate input switching ranges for switching between logic states will, in effect, vary in the same way that the output voltage ranges between the logic states vary with respect to the gate supply voltage.

Thus, there is a desire to provide a reference voltage at the base of the reference transistor in the emitter-connected transistor pair forming a CML logic gate that varies in correspondence with changes in the CML logic gate voltage supply. A typical voltage for a CML logic gate supply is 3.3 V±5%. The voltage value for the voltage reference for such a CML logic gate operated at such a supply voltage might typically be 3.1 V at room temperature. Thus, there will be substantial difficulty in providing such a voltage reference using the CML logic gate supply voltage because of the small voltage difference between them. This small difference would lead to requiring a pass transistor to operate with a few tenths of volts thereacross, or less, which presents substantial circuit difficulties.

Fortunately, many monolithic integrated circuits using CML logic gates therein also use transistor-transistor logic (TTL) gates to provide sufficient signal strength for operating certain kinds of circuits such as those on different integrated circuit chips. The typical voltage supply value for TTL logic circuits is 5.0 V±10%. Thus, a source of a larger value voltage is typically available for use by a reference generator in providing the reference voltage necessary for operating CML logic gates. However, the wide voltage value ranges in which these two voltage supplies operate, given the tolerances indicated for them above, can lead to substantial difficulties in providing the desired reference voltage. Thus, there is desired a reference voltage generator which can provide a reference voltage for CML logic gates that follows changes in the CML logic gate supply but can tolerate the changes occurring in the TTL gate and the CML gate voltage supplies.

SUMMARY OF THE INVENTION

The present invention provides a reference generator based on a pair of differentially connected transistor devices having a current sink at that connection. One leg of the differential pair is adapted to be connected to a first voltage supply with the other leg connected at one end thereof to a series-connected pair of impedances, the other end of these impedances being adapted to be connected to a second voltage supply. A clamp connected between the juncture of the series impedances and the leg of the differential pair of the transistor device adapted for connection to the first voltage supply keeps this juncture within a selected range of voltage values about the voltage on that leg. The differential pair can be a pair of emitter-connected bipolar transistors. The base of the transistor connected to the series-connected impedances is connected to the generator output, and a collector of that transistor operates a transistor having the emitter connected to that output and its collector connected to the clamp. The base of the transistor having its collector adapted for connection to the first voltage supply is connected to the generator input, and can be connected thereto through a voltage translation means.

DETAILED DESCRIPTION OF THE PREFERRED EMBODIMENTS

Figure 1:
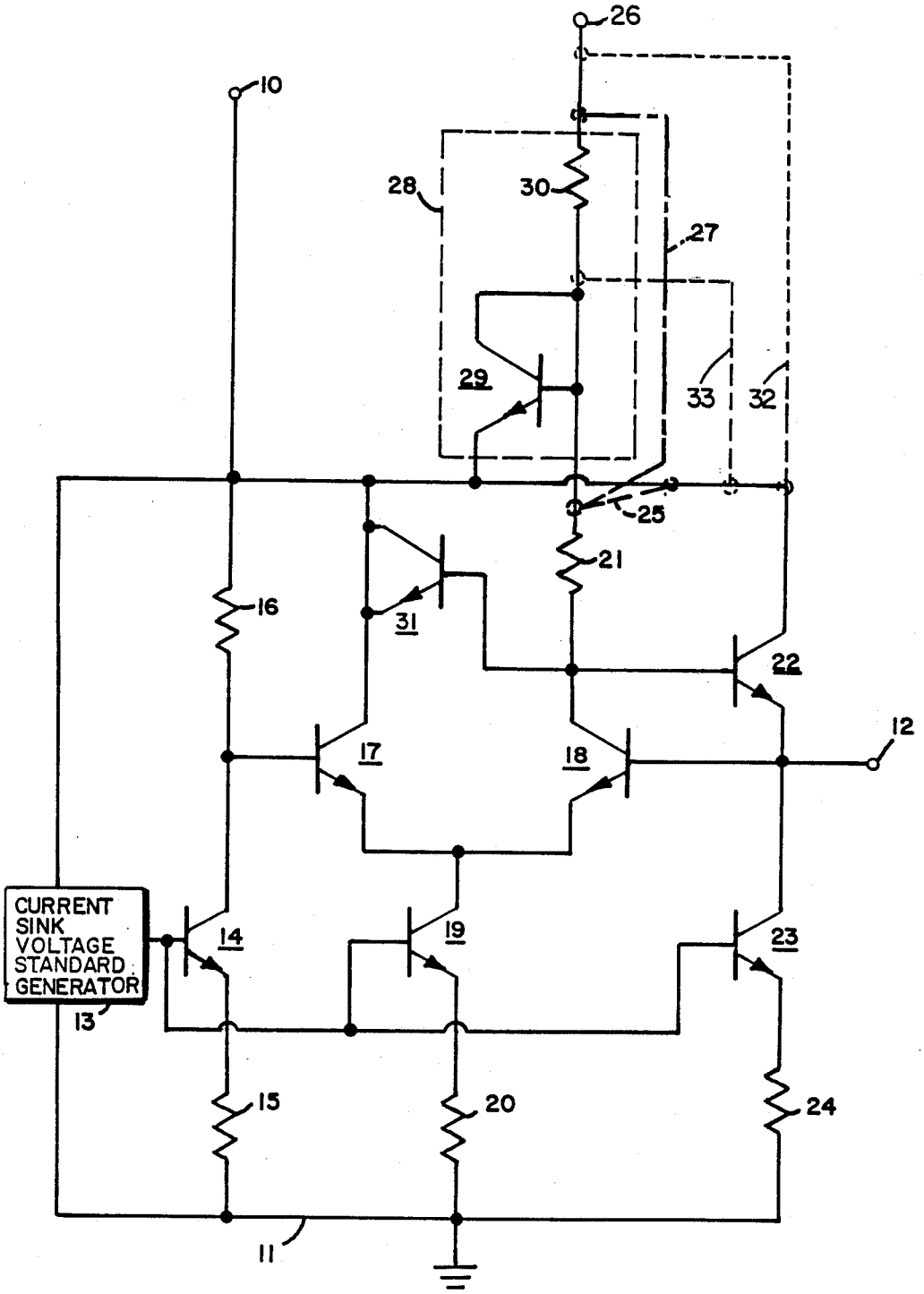
FIG. 1 shows a circuit schematic diagram of the present invention.

FIG. 1 shows a schematic diagram of a voltage reference generator for supplying an output reference voltage to be used as the reference voltage for CML logic gates. The reference generator is constructed of bipoplar transistors and resistors just as are CML logic gates. Thus, the circuit of FIG. 1 can be implemented in a monolithic integrated circuit chip along with CML logic gates using the same fabrication process.

All of the resistors shown in the circuit of FIG. 1 are typically fabricated as part of the ion implantation step used in forming a portion of the base regions, the inactive base regions, of the npn bipolar transistors constructed in the integrated circuit chip. Thus, these resistors will track one another in resistance value over temperature excursions and fabrication process variations. These resistors can be fabricated separately with other structures in the integrated circuit chip fabrication but, however done, they should match one another well so they track each other in value. To obtain a monolithic integrated circuit having a high density of CML logic gates, the fabrication process typically uses oxide trench isolation for electrically isolating various circuit components.

The CML logic gate supply voltage is to be connected between a terminal, 10, and a ground reference terminal, 11, with the positive voltage on terminal 10. A reference generator must provide a substantially constant output voltage at an output, 12, with respect to terminal 10 to be suitable for the generator of FIG. 1. This output must be based on a voltage standard of some sort, and if such a voltage standard is available that has a value which equals the desired output voltage, the generator need only provide power amplificaton of such a voltage standard which can then be supplied as a command value connected to the generator input.

However, in only rare situations will an available voltage standard have a value equal to the desired output voltage. Usually, the standard must be selected, in a monolithic integrated circuit chip, based on what is otherwise available there, and then that reference voltage manipulated to provide the desired output reference voltage at the output of the reference generator.

Such a voltage standard is conveniently available in a CML logic gate based monolithic integrated circuit chip. This standard is the voltage used to operate current sinks connected in series with the emitters of emitter-connected pairs of transistors (or with a greater number of emitter-connected transistors that may be used on the gate input side as described above) in the CML logic gates.

Such a voltage standard in a monolithic integrated circuit is often provided by a "bandgap" voltage standard generator. A bandgap voltage standard generator can be fabricated to provide a voltage with a zero temperature coefficient in low voltage circuits as is well known. Further, such a bandgap generator can be arranged so as to provide a temperature coefficient of a fixed value. Thus, a current sink voltage standard generator, 13, is shown in FIG. 1 based on whatever voltage standard is used for current sinks in the CML logic gates to be used in the chip with the generator of FIG. 1, typically a bandgap voltage reference.

The output of current sink voltage standard generator 13 is shown in FIG. 1 connected to the base of an npn bipolar transistor, 14, serving in a current sink as part of a voltage translation circuit. This voltage translation circuit is to provide a voltage equal to the desired output voltage, as a command to an amplifier system to be described below comprising the remainder of the circuit. Transistor 14 has a resistor, 15, connected between its emitter and ground reference terminal 11 to complete the current sink. The voltage provided by current sink voltage standard generator 13 at the base of transistor 14 determines, along with the value of resistor 15, the current which must flow through resistor 15 to provide a voltage drop across it sufficient to match the voltage of current sink voltage standard generator 13 less the base-emitter voltage drop of transistor 14.

Current sink voltage standard generator 13 has an output voltage with a temperature coefficient which is sufficiently negative so that it less the negative temperature coefficient of the base-emitter junction of transistor 14 will just offset one another. This results in the voltage across resistor 15 being substantially constant in value over temperature changes. The temperature coefficient of the resistance value of resistor 15 leads to a current therethrough varying with temperature even with a constant voltage thereacross which is acceptable as will be seen below. The nominal voltage supplied by current sink voltage standard generator 13 at room temperature is 1.3 V, and the resistance of resistor 15 is typically 476Ω.

There is a further resistance, 16, in the voltage translation circuit portion of FIG. 1 connected between the collector of transistor 14 and CML voltage supply terminal 10. Resistor 16 has a typical value of 200Ω. As indicated above, the resistance value of this resistor tracks that of resistor 15 so that the ratio of resistance values remains substantially constant. The current passing through resistor 15 leads to a current of a similar magnitude passing through resistor 16, the difference only being the base current in transistor 14 which, for transistor 14 having a sufficiently high common emitter current gain, will be negligible. This current through transistor 16, varied only by the temperature induced changes in the resistance value of resistor 15, leads to a fixed voltage drop occuring thereacross. This occurs because the temperature variation in resistor 16, in tracking that of resistor 15, counteracts the variation in the current therethrough. As a result, the collector of transistor 14 is always at a substantially fixed value of voltage below the voltage occurring at terminal 10 as supplied by the CML voltage supply. Variations in the output voltage value of that voltage supply lead to variations in voltage at the collector of transistor 14 because the voltage drop across resistor 16 does not change since the current therethrough is held substantially constant.

As a result, the proper choice of resistance values for resistors 15 and 16, for a particular voltage output from current sink voltage standard generator 13, leads to a desired voltage occurring at the collector of transistor 14 subject to variations to the extent that the CML voltage supply varies. However, this variation in voltage at collector 14, following the voltage changes in the voltage supply connected at terminal 10, is just the variation in logic state output voltages in the CML logic gate circuits provided elsewhere in the monolithic integrated circuit chip as explained above. Since the voltage at the collector of transistor 14 is a command voltage setting the voltage value to be provided at output 12 of this generator, as indicated above and as will be described below, the output voltage at output 12 of the generator of FIG. 1 will follow this variation in voltage at the collector of transistor 14. Thus, the reference voltage provided at output 12 for the CML logic gates in the rest of the chip will vary as the CML gate supply voltage varies keeping the gate input switching ranges appropriately related to the gate output logic state voltages as desired.

The command voltage provided at the collector of transistor 14 is applied to the input of a feedback amplifier system having an input stage formed by a differential amplifier. This amplifier has a pair of npn bipolar transistors, 17 and 18, having their emitters connected to one another and to a collector of a further transistor, 19, forming part of a current sink. This current sink operates like that provided in the voltage translating circuit described above. The base of transistor 19 is again connected to the output of current sink voltage standard generator 13, and has its emitter connected to ground reference terminal 11 through a further resistor, 20. This combination operates just as the combination of transistor 14 and resistor 15 did, but resistor 20 here typically has a value of 922Ω to result in a smaller current being sunk by this current sink as compared to the current sunk in the sink used in the voltage translating circuit.

The collector of transistor 17 in the differential amplifier emitter-connected circuit pair is connected to terminal 10 to receive the voltage of the CML logic gate voltage supply. The collector of transistor 18 is connected to another resistor, 21, and to the base of a further npn bipolar transistor, 22, serving as the output stage of the amplifier. Thus, the voltage occuring at the collector of transistor 18 provides the output signal of the input differential amplifier stage to operate output stage transistor 22. Resistor 21 has a typical value of 746Ω.

Transistor 22 is connected as an emitter follower through having its emitter connected to reference generator output 12, and its collector connected to terminal 10. The emitter load for transistor 22 in the circuit, disregarding the loads which may be connected to output 12, is another current sink formed by another npn bipolar transistor, 23, and a further resistor, 24. This output load current sink comprising these latter two circuit components again operates just as does the voltage translating circuit current sink components transistor 14 and resistor 15, but the value of resistor 24 is typically 750Ω to again give a somewhat smaller sink current.

The connection of the end of resistor 21 opposite its connection to the collector of transistor 18 is the source of the problem with CML logic gate circuit voltage reference generators. The first possibility is to connect resistor 21 to terminal 10 for the CML voltage supply, a possible connection indicated by a short dashed line, 25. However, with the typical command voltage at the input of the differential amplifier, and so the base of transistor 17, being 3.1 V, a circuit with connection 25 cannot provide a voltage at generator output 12 that equals the command voltage of 3.1 V.

The base-emitter junction of transistor 22 will have a required voltage drop thereacross of 0.6 V to 0.8 V, as is typical for silicon bipolar transistors, to be sufficiently "on" to supply the current required for the current sink comprising transistor 23 and resistor 24. This will result in generator output 12 being at a voltage equal to a voltage which is less than the CML supply voltage supplied to terminal 10 by at least this base-emitter voltage drop across transistor 22. Since the generator output voltage on terminal 12 is desired to be closer to the voltage that can be supplied on terminal 10 than the base-emitter voltage of transistor 22, it must always be in the "off" condition. Thus, for example, if the maximum voltage possible is supplied to terminal 10 of just under 3.5 V, the generator output voltage on terminal 12 can be no more than 2.8 V to 2.9 V. As a result, transistor 18 will also be in the "off" condition, and there will be a permanent difference between the command voltage at the base of transistor 17 and the voltage at output 12.

The presence of a TTL logic gate supply permits overcoming this situation by allowing resistor 21 to be connected to a higher value source of voltage. Such a voltage supply is provided at a further terminal, 26. An alternating short and long dashed line connection, 27, is shown in FIG. 1 for implementing this alternative. However, this connection, too, presents difficulties in providing a precise output voltage at generator output 12.

This difficulty comes about because of the variance in the values of output voltages from the CML and TTL logic circuit supply voltages applied to terminals 10 and 26, respectively, and the independence of these variations. The voltage at terminal 10 can vary about 3.3 V by approximately ±0.2 V. Such a variance in voltage at terminal 10 will lead to a variance in the voltage at the collector of transistor 18 as the differential amplifier formed by transistors 17 and 18 attempts to force the voltage at generator output 12 toward the command voltage on the base of transistor 17 which reflects this variation.

The base-emitter voltage drop across transistor 22 requires the voltage at the collector of transistor 18 to be above the voltage at generator output 12 by the amount of that drop. The voltage at terminal 26 on the other side of resistor 21 is the TTL logic circuit supply voltage of 5.0 V±0.5 V. The voltage values supplied by the CML logic circuit voltage supply at terminal 10 and the TTL logic circuit voltage supply at terminal 26 vary independently of one another in the monolithic integrated circuit chip. Hence, in the worst case the one may be a maximum when the other is a minimum. This leads to the voltage drop being required across resistor 21 which can vary from a value something over 0.5 V to a value exceeding 2.0 V. Thus, transistor 18 must be capable of drawing a current through resistor 21 that can nave a maximum value which is several times its minimum value.

Transistor 18 will, at the current levels involved, have a resulting change in the voltage drop across its base-emitter junction which can amount to tenths of a volt over such a range of collector current therethrough. Thus, the voltage drop across the base-emitter junction of transistor 18 will vary, and will vary from that voltage drop across the base-emitter junction of transistor 17. This variance leads to the output voltage on generator output 12 differing from the command voltage on the base of transistor 17. Thus, there will be an error in the output voltage. In addition, the current sink comprising transistor 19 and resistor 20 must be operated at a substantial current value to be able to sink the maximum current which could flow through transistor 18 thus increasing the current drawn by the monolithic integrated circuit in which the generator of FIG. 1 is provided.

A substantial improvement in this situation is provided by the circuit components shown in a dashed line box, 28, in FIG. 1. These additional circuit components include a further npn bipolar transistor, 29, having its base and collector connected together and to the junction of resistor 21, and a further resistor, 30. The other end of resistor 30, typically having a value of 400Ω, is connected to terminal 26 and so is to be connected to the TTL logic circuit voltage supply. The emitter of transistor 29 is connected to the collectors of transistors 17 and 22 and one side of resistor 16, i.e. connected to terminal 10 at which there is provided the CML logic circuit voltage supply. The result is that transistor 29, acting as a diode, clamps the side of resistor 21 opposite its connection to the collector of transistor 18 to being within the base-emitter voltage drop of transistor 29 of the CML logic circuit voltage supply.

Thus, changes in voltages at either end of resistor 21 will follow changes in voltage value of the CML logic circuit voltage supply. As a result, a substantially constant voltage will occur across resistor 21 for a selected voltage drop across resistor 16 leading to the command voltage supplied at the base of transistor 17. Hence, the current to be drawn by the differential amplifier formed by transistors 17 and 18, and its resulting current sink, will be substantially constant also. This permits setting the current to be sunk by that current sink, comprising transistor 19 and resistor 20, at a value sufficient for the known currents which will flow through transistors 17 and 18 regardless of the values of the voltages occurring at terminals 10 and 26. The voltage drop chosen for resistor 21 can be relatively small enabling a relatively small current to be sunk by the current sink connected to the emitters of transistor 17 and The voltage changes between the supplies connected to terminals 10 and 26 are taken up by resistor 30 through the supply connected to terminal 26 supplying sufficient current through resistor 30 and through diode-connected transistor 29 to result in the necessary voltage drop across resistor 30. Excess current passing through diode-connected transistor 29 is passed by the power supply connected to terminal 10.

Because of the feedback around the amplifier of FIG. 1 comprising the input stage with emitter-connected transistors 17 and 18 and the output stage with transistor 22, there is the possibility of instability in the amplifier performance. An npn bipolar transistor, 31, having its collector and its emitter connected to the collector of transistor 17, i.e. to terminal 10, is shown with its base connected to the collector of transistor 18. Transistor 31, in this arrangment, has its base-emitter and base-collector junctions slightly forward biased but still in the "off" condition. The capacitance of these slightly forward biased junctions between these collectors of transistors 17 and 18 provides the necessary compensation to assure stability.

The collector of output transistor 22, as indicated above, has been shown connected to terminal 10 for the CML voltage supply to provide a source of output current. However, this collector can be connected to any voltage source of a value sufficiently greater than the output voltage desired on generator output 12. One such alternative connection is shown in FIG. 1 where the collector is shown by a short dashed line interconnection, 32, being connected to terminal 26 for the TTL voltage supply. Should noise on the TTL voltage supply output be too great, a further alternative connection, 33, for the collector of transistor 22 is shown in short dashed lines made to the juncture of resistors 21 and 30. This juncture has a voltage which is regulated to an extent desired above to limit noise thereof.

Although the present invention has been described with reference to preferred embodiments, workers skilled in the art will recognize that changes may be made in form and detail without departing from the spirit and scope of the invention.

What is claimed is:

1. A reference generator having an input and an output for providing a selected output reference voltage at said generator output, said output reference voltage at said generator output being substantially equal to a selected command voltage of a value to be controlled at said generator input with respect to a first supply voltage established with respect to a datum voltage, said generator comprising:

input and output current shifting means each having a first and second terminating region and each having a control region therein by which it is capable of being directed, through electrical energization thereof, to effectively provide a conductive path of a selected conductivity between its first and second terminating regions, said input current shifting means control region being electrically connected to said generator input, said input current shifting means first terminating region being electrically connected to a first terminal means adapted for connection to a source of said first supply voltage, said input current shifting means second terminating region being electrically connected to said output current shifting means second terminating region, said output current shifting means control region being electrically connected to said generator output;

a first current determination means having first and second terminating regions between which it exhibits an electrical impedance, said first current determination means first terminating region being electrically connected to both of said input and output current shifting means second terminating regions, said first current determination means second terminating region being electrically connected to a second terminal means adapted for electrical connection to a source of said datum voltage;

first and second series impedance means each having first and second terminating regions between which it exhibits an electrical impedance, said first series impedance means first terminating region being electrically connected to a third terminal means adapted for electrical connection to a source of a second supply voltage, said first series impedance means second terminating region being electrically connected to said second series impedance means first terminating region, said second series impedance means second terminating region being electrically connected to said output current shifting means first terminating region;

a clamping means having first and second terminating regions between which it has a relatively low electrical impedance for voltages thereacross beyond a threshold voltage value, said clamping means first terminating region being electrically connected to both said first series impedance means second terminating region and to said second series impedance means first terminating region, said clamping means second terminating region being electrically connected to said first terminal means; and an output supply means having first and second terminating regions and having a control region therein by which it is capable of being directed, through electrical energization thereof, to effectively provide a conductive path of a selected conductivity between its first and second terminating regions, said output supply means control region being electrically connected to both said second series impedance means second terminating region and said output current shifting means first terminating region, said output supply means first terminating region being electrically connected to a fourth terminal means adapted for connection to a source of a third supply voltage, and said output supply means second terminating region being electrically connected to said generator output.

2. The apparatus of claim 1 wherein said input current shifting means control region is electrically connected to said generator input through a voltage level translation means such that a selected voltage value can be applied at said generator input differing in value from that value selected for said command voltage, and yet that said command voltage value selection can be provided at said input current shifting means control region.

3. The apparatus of claim 1 wherein there is further provided a second current determination means having first and second terminating regions between which it exhibits an electrical impedance, said second current determination means first terminating region being electrically connected to said generator output, said second current determination means second terminating region being electrically connected to said second terminal means.

4. The apparatus of claim 1 wherein said first current determination means comprises a first current sink formed of a first determination device having first and second terminating regions and having a control region therein by which it is capable of being directed, through electrical energization thereof, to effectively provide a conductive path of a selected conductivity between its first and second terminating regions, said first determination device first terminating region being electrically connected to said first current determination means first terminating region, said first determination device control region being electrically connected to a fifth terminal means adapted for electrical connection to a source of a first reference voltage, and wherein said first current determination means further comprises a first determination impedance means having first and second terminating regions between which it exhibits an electrical impedance, said first determination impedance means first terminating region being electrically connected to said first determination device second terminating region, said first determination impedance means second terminating region being electrically connected to said second terminal means.

5. The apparatus of claim 1 wherein said fourth terminal means is electrically in common with said first terminal means and said third supply voltage is provided by said first supply voltage.

6. The apparatus of claim 1 wherein said fourth terminal means is electrically in common with said third terminal means and said third supply voltage is provided by said second supply voltage.

7. The apparatus of claim 2 wherein said voltage translation means comprises a translating device having first and second terminating regions and having a control region therein by which it is capable of being directed, through electrical energization thereof, to effectively provide a conductive path of a selected conductivity between its first and second terminating regions, said translating device control region being electrically connected to said generator input, and wherein said voltage translating means further comprises first and second translating impedance means each having first and second terminating regions between which it exhibits an electrical impedance, said first translating impedance means first terminating region being electrically connected to said translating device second terminating region, said first translating impedance means second terminating region being electrically connected to said second terminal means, said second translating impedance means first terminating region being electrically connected to said first terminal means, and said second translating impedance second terminating region being electrically connected to both said input current shifting means and said translating device first terminating region.

8. The apparatus of claim 3 wherein said second current determination means comprises a second current sink formed of a second determination device having first and second terminating regions and having a control region therein by which it is capable of being directed, through electrical energization thereof, to effectively provide a conductive path of a selected conductivity between its first and second terminating regions, said second determination device first terminating region being electrically connected to said second current determination means first terminating region, said second determination device control region being electrically connected to a fifth terminal means adapted for electrical connection to a source of a first reference voltage, and wherein said second current determination means further comprises a second determination impedance means having first and second terminating regions between which it exhibits an electrical impedance, said second determination impedance means first terminating region being electrically connected to said second determination device second terminating region, said second determination impedance means second terminating region being electrically connected to said second terminal means.

9. The apparatus of claim 6 wherein said output supply means first terminating region is electrically connected to said third and fourth terminal means through said first series impedance means.

10. The apparatus of claim 7 wherein said first current determination means comprises a first current sink formed of a first determination device having first and second terminating regions and having a control region therein by which it is capable of being directed, through electrical energization thereof, to effectively provide a conductive path of a selected conductivity between its first and second terminating regions, said first determination device first terminating region being electrically connected to said first current determination means first terminating region, said first determination device control region being electrically connected to said generator input, and wherein said first current determination means further comprises a first determination impedance means having first and second terminating regions between which it exhibits an electrical impedance, said first determination impedance means first terminating region being electrically connected to said first determination device second terminating region, said first determination impedance means second terminating region being electrically connected to said second terminal means.

11. The apparatus of claim 7 wherein said input and output current shifting means, said clamping means, said output supply means and said translating device are formed by bipolar transistors.

12. The apparatus of claim 10 wherein said second current determination means comprises a second current sink formed of a second determination device having first and second terminating regions and having a control region therein by which it is capable of being directed, through electrical energization thereof, to effectively provide a conductive path of a selected conductivity between its first and second terminating regions, said second determination device first terminating region being electrically connected to said second current determination means first terminating region, said second determination device control region being electrically connected to said generator input, and wherein said second current determination means further comprises a second determination impedance means having first and second terminating regions between which it exhibits an electrical impedance, said second determination impedance means first terminating region being electrically connected to said second determination device second terminating region, said second determination impedance means second terminating region being electrically connected to said second terminal means.

13. The apparatus of claim 12 wherein said input and output current shifting means, said clamping means, said output supply means, said translating device and said first and second determination devices are bipolar transistors.

* * * * *